United States Patent [19]

Rayburn

[11] 4,017,818

[45] Apr. 12, 1977

[54] THERMAL SWITCH DEVICE AND METHOD OF MAKING

[75] Inventor: Charles Calvin Rayburn, Mount Prospect, Ill.

[73] Assignee: Illinois Tool Works Inc., Chicago, Ill.

[22] Filed: Dec. 22, 1975

[21] Appl. No.: 642,650

[52] U.S. Cl. ..... 337/403; 337/404; 337/407

[51] Int. Cl.[2] ..... H01H 37/76

[58] Field of Search ..... 337/401, 402, 403, 404, 337/405, 406, 407, 411, 414, 415, 417, 4, 5; 168; 29/623, 622; 169/42

[56] References Cited

UNITED STATES PATENTS

| | | | |
|---|---|---|---|
| 662,032 | 11/1900 | Sitts | 337/407 |
| 2,149,773 | 3/1939 | Huntley | 337/404 |
| 3,198,914 | 8/1965 | Baran | 337/414 |
| 3,519,972 | 7/1970 | Merrill | 337/407 |
| 3,956,725 | 5/1976 | Merrill et al. | 337/407 |

*Primary Examiner*—Harold Broome

*Attorney, Agent, or Firm*—Thomas W. Buckman; Robert W. Beart

[57] ABSTRACT

A thermal switch for automatically opening a circuit when the ambient temperature is increased to a predetermined level. A pair of conductor wires are arranged in side by side fashion with extremities extending in the same direction. A spring portion is included in at least one of the conductor wires to provide stored energy when the spring is biased into electrical contact with each other. A localized contact region is included in the conductor wire in the region below the spring portion. The extremities, contact region, and spring being encapsulated with a heat fusible material which biases the conductor wires into contact with each other and which is coated with a rigid insulating material to retain the conductor wires electrically insulated from each other except at the contact region. The heat fusible material holding the conductors into electrical contact until the temperature level reaches the level at which the fusible material flows thereby allowing the contacts to be separated due to the energy stored by the spring.

16 Claims, 12 Drawing Figures

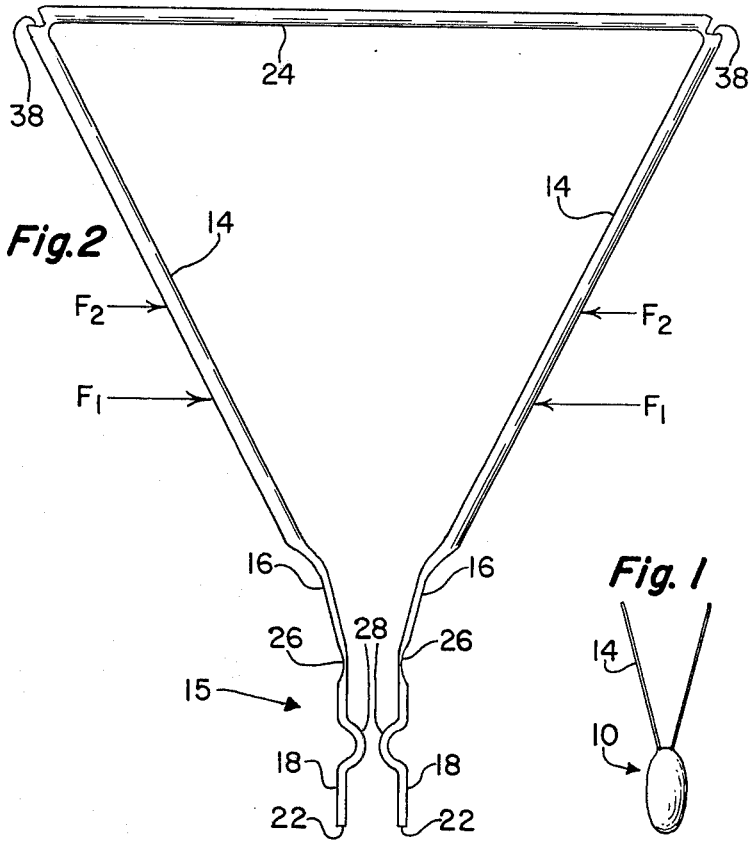
Fig.2
24
38
38
14
14
F2
F2
F1
F1
16
16
26
28
26
15
18
18
22
22
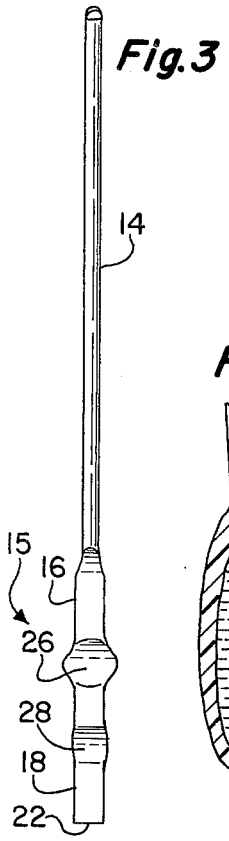
Fig.3
14
15
16
26
28
18
22
Fig. 1
14
10
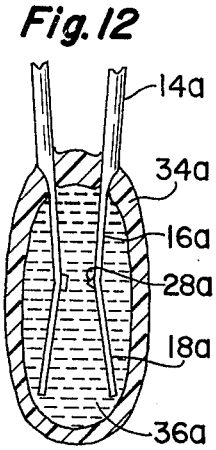
Fig.12
14a
34a
16a
28a
18a
36a
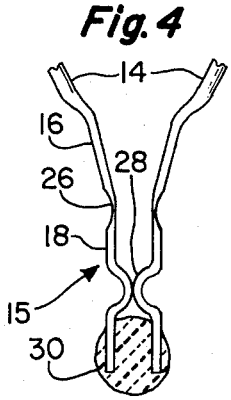
Fig.4
14
16
28
26
18
15
30
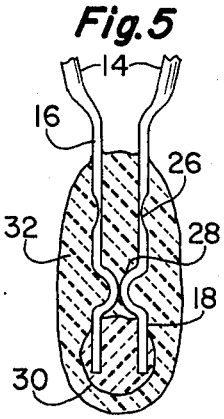
Fig.5
14
16
26
32
28
18
30
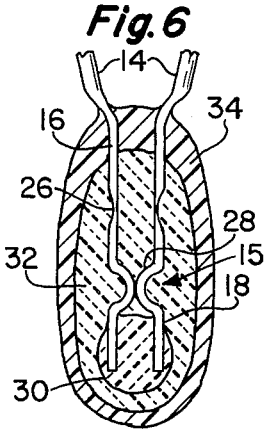
Fig.6
14
16
34
26
28
32
15
18
30
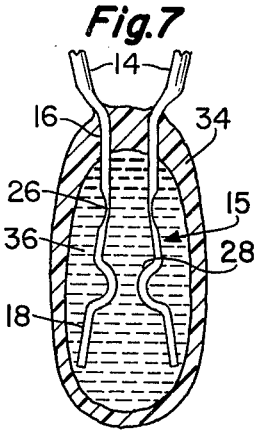
Fig.7
14
16
34
26
15
36
28
18
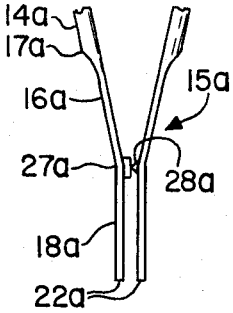
Fig.8
14a
17a
16a
15a
27a
28a
18a
22a
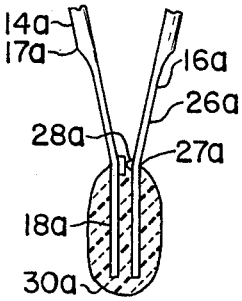
Fig.9
14a
17a
16a
26a
28a
27a
18a
30a
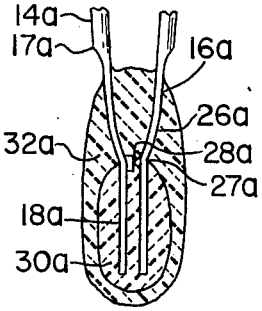
Fig.10
14a
17a
16a
26a
32a
28a
27a
18a
30a
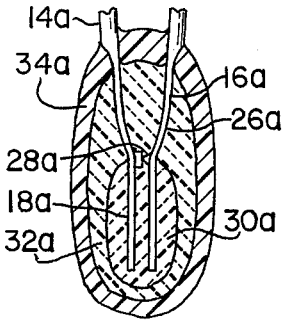
Fig.11
14a
34a
16a
26a
28a
18a
30a
32a

THERMAL SWITCH DEVICE AND METHOD OF MAKING

BACKGROUND OF THE INVENTION

This invention relates generally to a switch which is responsive to an ambient temperature level.

The invention more particularly relates to an unresettable switch which will open a circuit when the ambient temperature around the circuit is increased to a predetermined level.

Switches of the type described have become necessary to protect various circuitry in devices such as appliances, etc., from the hazards of high temperatures generated therein. An increasing awareness of the hazards that present themselves as a result of a device which is capable of generating unchecked levels of heat emphasizes the importance of incorporating thermal switches in such devices. Not only destruction to the device but to the immediate surroundings could possibly be eliminated through the use of a switch which is capable of accurately sensing the increase in ambient temperature level to a predetermined amount and quickly and reliably opening the circuit to stop the flow of current therein.

Prior art devices of the type described are generally multi-piece units with a conductive casing. The multipiece devices of the prior art are inherently costly to produce with a high level of quality control. One such prior art device utilizes a pair of coaxially arranged conductor wires, one of which is electrically connected to an outer conductive casing and the second of which is placed in releasable contact with the conductive casing through a thin washer member. The washer member is urged into contact with the second conductor wire through a spring and a thermal pellet. When a predetermined temperature level is reached, the thermal pellet liquifies, thus releasing the spring energy and allowing a secondary spring to force the washer out of contact with the second conductor wire. Such a device has approximately eight to ten different elements not including the conductor wires.

It is the primary object of the invention to provide a thermal switch device with a minimum of elements.

A further object of the invention is to provide a thermal switch device which is capable of quickly and reliably opening a circuit at a predetermined temperature level.

A still further object of the invention is to provide a thermal switch device which reduces arcing between contact points as the switch is opened.

Still a further object of the invention is to provide a thermal switch device which provides a generally constant cross-sectional area in the current carrying elements to minimize hot spots in the circuit.

A particular advantage of the present invention is the provision of a thermal switch device which is encased with a nonconductive material which facilitates the x-ray inspection of such a device.

The above and other objects and advantages are achieved by the present invention which basically provides for the encapsulation of contact regions of conductor wires, when spring loaded into contact with each other, with a heat fusible material, such as an appropriate organic mixture, followed by a coating or encapsulation of a rigid insulating material providing a structural and protective encasement for the circuitry while insulating the conductor wires from one another except at the contact region. The spring energy is provided in the system by forming a section of at least one of the conductor wires, adjacent the terminal extremity and below a spring hinge region, away from and out of line with the conductor wire section above a spring hinge region. A localized contact region is provided below the spring hinge region so that contact regions may be forced together into electrical contact by a slight, lateral compression force and dipped or encapsulated in a heat fusible material, followed by a second compressive force to load the spring while dipping or encapsulating the contact region in a similar heat fusible material. The heat fusible material will be encapsulated with a rigid insulating material to structurally support the circuit. The encapsulated region will thus provide a closed circuit until the fusible material flows releasing the energy stored in the spring.

BRIEF DESCRIPTION OF THE DRAWINGS

FIG. 1 is an elevation of the completed thermal switch being drawn generally to the same scale and size as an actual switch constructed in accordance with the invention.

FIG. 2 is an elevational view of a conductive wire preform used in the construction of a preferred embodiment of the invention.

FIG. 3 is a side view of the preform shown in FIG. 2.

FIG. 4 is a partial elevational view of the preform during a first step in the manufacture of a switch in accordance with the invention.

FIG. 5 is a partial elevational view of the preform during a second step in the manufacture of a device in accordance with the invention.

FIG. 6 is a cross-sectional view of the switching portion of the device of the invention following its final manufacturing step and in a loaded condition.

FIG. 7 is a cross-sectional view of the device similar to that shown in FIG. 6 after the circuit has opened.

FIG. 8 is a partial elevational view of a secondary embodiment of the invention.

FIG. 9 is a partial elevational view of the preform of the embodiment in FIG. 8 following the first step in the manufacture of a device in accordance with the invention.

FIG. 10 is a partial elevational view of the switch portion of the embodiment of FIG. 8 following a second step in the construction of the device.

FIG. 11 is a cross-sectional view of the alternate embodiment of the switch following the last construction step and showing it in a loaded position.

FIG. 12 is a cross-sectional view of the device shown in FIG. 11 showing the circuit in an open condition.

DESCRIPTION OF THE PREFERRED EMBODIMENT

The thermal switch device 10 shown in FIG. 1, and in more detail in FIG. 6, will first be described relative to the various steps to manufacture a preferred embodiment thereof and with particular reference to FIGS. 2–5.

A length of conductive wire is first formed into a generally U-shaped configuration, such as shown in FIG. 2, to include an open portion and a closed bight portion at opposing ends of the preform. The closed portion, in the preferred embodiment, will be constructed of a lead wire sections 14 which are spaced from one another a distance greater than the switch sections 15 of the wire adjacent the open end of the preform. The switch sections 15 adjacent the open end will generally consist of two subsections 16 and 18. The lower subsection 18 will include portions extending laterally outwardly from the upper subsection 16 such as resulting from being formed at an angle to one another and interconnected by a spring-like hinge 26. A localized contact region 28 is included in the switch section and is preferably positioned intermediate the extremities 22 of the conductor wire and the associated spring region 26. The cross-sectional configuration of the switch sections 15 are deformed from the generally circular cross section in the lead portions 14 to a substantially flat configuration for a purpose to be described later herein.

The contact region 28 may advantageously be formed in the switch section 15 as a protuberance or protuberances extending toward opposing faces of the conductor wire.

The preform in the condition shown in FIG. 2 may be subjected to a slight compressive force F1, preferably in the upper region of the preform and exerted on the lead wire portions 14. This initial force brings the opposing switch sections 15 together so that the contact point or points 28 are in physical electrical contact with each other. In this position, the extremities 22 of the conductor wire are dipped in a heat fusible material, such as an organic, having a predetermined melting or flowing temperature. The dipping is, of course, done while the organic is in a liquid state followed by cooling to room temperature, subsequent to the dipping, to produce an initial encapsulation 30 which will hold the contacts together in the position shown in FIG. 4.

With the preform in the retained position shown in FIG. 4, a subsequent lateral force F2 is applied to the upper region of the preform. This force F2 will be of a greater force than the initial force and of a value great enough to overcome the spring bias of the spring means 28 and bring the upper section 16 into alignment with the lower section 18. With the spring loaded in this manner, the switch section is subjected to a second dip of heat fusible organic material to provide a complete covering 32 of the spring region 26, the contact point 28, portions of upper subsection 16, all of lower subsection 18, as well as the initial encapsulation 30. The two dips of fusible organic material may, of course, be of exactly the same material and may become essentially homogeneous. Upon cooling of the heat fusible material following this second dip, the circuit will be closed and the spring loaded in a subassembly shown in FIG. 5.

Attention is now directed to the preform shown in FIG. 2. The opposing terminal wire portions 14 will be severed at the bight portion to provide two leads for the component. The bight portion is preferably severed prior to the second dipping step in order to reduce the shear stress on the contact region. Notches 38 interconnecting terminal wire portions 14 facilitate such a severing.

Following the second dip step, the switch section of the device and the heat fusible encapsulation 32 is totally and conformally coated with a layer of rigid insulating material 34. This coating 34 may also be done in a dipping process but conventional casing techniques may be utilized as long as the casing intimately and conformally surrounds the heat fusible material and provides a structure for protecting the switch circuit while electrically insulating the lead wires 14 at their point of entry into the switch section. Certain types of epoxy material are capable of functioning as the rigid insulating encasing material as long as the material sufficiently resists cold flow responsive to the energy stored in the spring sections. However, while the invention may be herein described as utilizing epoxy as the encasing material, it should be understood that epoxy is only representative of a suitable material and the invention should not be restricted to a particular rigid insulating material.

The device shown in FIG. 6, thus, is representative of the switch in its final loaded condition capable of transmitting current from one lead wire 14 to the other. When the environmental or ambient temperature reaches a predetermined level, the heat fusible organic 30 and 32 will flow or liquify allowing the energy stored in the spring to be released and thus providing the open circuit structure shown in FIG. 7. The upper sections 16 will be locked in the epoxy so lower region 18 and contacts 28 will spring laterally outwardly relative to the opposing wire sections and resume a substantially relaxed position as the energy is released in the spring. The cavity within the epoxy coating 34 will contain generally only the heat fusible material so that when the organic melts the displaced organic will flow between the lead wires and increase the dielectric strength between the open contacts. This construction also acts to preclude the formation of a corona discharge since no air will be present to ionize.

The lead wire in the switch region 15 flattened to distribute the contact reaction force and, thus, the tendency of the energy being dissipated by cold flow of the organic. The switch section will also be of generally constant cross-sectional configuration which tends to eliminate hot spots in the electrical switch circuit. The spring sections are generally very thin and are extruded laterally with a generally concave surface formed in the outwardly facing portions of the wire. No more heat is dissipated in the spring portions than in any other unit length of the conductor wire. Since the spring section will have greater area per unit length than a round wire, it follows that the springs will be cooler than the remaining conductor in the event of a very high sustained current. Further, the heated fusion of the organic acts to heat sink the leads so that the leads will remain at approximately the organic melting point thus protecting the integrity of the spring.

Turning to FIGS. 8–12, a further embodiment of the invention is described which provides a continuing preloading force at the contact region to further enhance the reliability of the device. The switch section **15*a* of the embodiment differs from the device described above in the preferred embodiment by the addition of a secondary spring in the system at the point of contact. One of the conductor wire switch sections will include an upper portion 16*a* and a primary spring region 26*a* to load energy in the system in a manner similar to the system described above relative to FIGS. 1–7. The contact region 28*a* includes a further spring by virtue of hinge 27*a* at the contact region at the juncture of upper portion 16*a* and lower portion 18*a*.**

Both of the opposing conductor wire portions in the switch section **15*a* are flattened to a substantially continuous, thin cross-sectional configuration from tips 22*a* to the point of intersection 17*a* with the round lead wires 14*a*. Lower portions 18*a* are bent outwardly from the remaining, upper portions of the spring section. The bend lines 27*a* effectively provide a secondary spring in the system. The contact protuberances 28*a*** are located substantially at bend lines 27*a* and thereby serve as a fulcrum about which the springs in the system are loaded.

FIG. 9 shows that the first dip of the heat fusible material 30*a* is taken while the unit has been subjected to a first compressive force in a manner similar to that described above. A subsequent compressive force caused energy to be stored in upper region 16*a* by virtue of the bowing of region 26*a* above the contact points since the lower region is retained from separation while the lead wires 14*a* are forced together. Since the force of the bowed spring region 26*a* as well as the secondary spring 27*a* react at the contact region 28*a*, a continuous preloading condition is thereby established. FIG. 10 shows the second dipping step providing coating 32*a* during the loading of the spring region 26*a* to store energy. FIG. 11 shows the loaded switch encased in epoxy 34*a* to insulate and lock the leads in a manner such as described relative to the preferred embodiment above.

It has been found to be advantageous to provide an outer coating 32*a* having a slightly lower melting temperature than the inner coating 30*a*. This allows the contacts to be held together longer, creating a snap opening when coating 30*a* does melt.

FIG. 12 shows the relationship of the switch section 15*a* in an open condition when a predetermined ambient temperature level has been attained. Since the regions of the lead wire 14*a* adjacent the regions 16*a* are locked and insulated from one another in the epoxy coating 34*a*, the regions 16*a* and 18*a* will resume substantially the relaxed position once the energy has been dissipated. The relaxed position will thus open the electrical contact between fulcrum point 28*a* and the opposing wire surface.

This invention thus provides a spring loaded switch which encapsulates a pair of conductor wires in a first, contacting position under bias of a spring region in at least one of the conductor wires. The conductor wires are held in contact with each other against the bias of a hinge-like spring region until the encapsulating heat fusible material is subjected to a predetermined temperature level. At such a temperature level, the conductor wires move to a second, relaxed position, out of contact with each other thus opening the circuit.

Thus, it is apparent that there has been provided in accordance with the invention a thermal switch device that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

I claim:

1. A thermal switch device comprising a pair of electrical conductor wire members in side by side relationship to each other and having free ends extending generally in the same direction forming switch sections and lead wire sections, the switch section including a localized contact region providing an electrically conductive path between the wire members, at least one of said conductor wire members in the switch section including a spring means biasing the contact regions and adjacent portions of the pair of conductor wire members away from each other, the free extremities, contact region and at least a portion of the spring means being encapsulated with a nonconductive heat fusible material with the conductor wires being held, against the spring bias, into electrical contact with each other, by the encapsulating material, the nonconductive heat fusible material and portions of the conductor wire adjacent the spring means which extend out of the encapsulated material being conformally coated with a rigid insulating material to totally encapsulate the heat fusible material and space and electrically insulate the extending lead wire sections from each other, wherein the conductor wires of the encased switch section are adapted to spring away from and out of contact from each other at the contact region when the heat fusible material is subjected to a predetermined temperature level causing it to flow and release the energy stored in the spring means.

2. The thermal switch device in accordance with claim 1, wherein at least a portion of the switch section of the conductor wire adjacent the contact region is flattened so as to distribute the area of spring energy acting on the heat fusible material to reduce cold flow of the conductors within the heat fusible material which could cause the electrical contact to open prematurely.

3. The thermal switch device is accordance with claim 1, wherein both conductor wire members include a spring means.

4. The thermal switch device in accordance with claim 1, wherein the spring means is provided on one of the two conductor wire members.

5. The thermal switch device in accordance with claim 1, wherein the contact region is a protuberance extending from the face of one of the conductor wire members.

6. The thermal switch device in accordance with claim 1, wherein the conductor wire which includes said spring means is provided with a secondary spring portion spaced upwardly from the free extremity of the conductor wire member and intermediate the free extremity and the spring hinge means, the secondary spring portion being substantially at the localized contact region so that said contact region serves as a fulcrum point for the secondary spring to provide a preload at the contact region enhancing the reliability of the electrical contact.

7. The thermal switch device of claim 1, wherein the heat fusible material is an organic substance.

8. The thermal switch device of claim 1, wherein the spring means is a hinge region of reduced thickness and increased width on the conductor wire.

9. The thermal switch device of claim 8, wherein the outwardly facing region of the spring hinge is a concave surface.

10. The thermal switch device of claim 1, wherein the conductor wire portions which are encapsulated are substantially flat and extend in substantially parallel planes when encapsulated.

11. A method of forming a thermal switch device of the type including a pair of conductor wire members in side by side relationship and having free extremities extending generally in the same direction and adapted to spring apart, out of electrical contact with each other when a predetermined temperature level is attained, including the steps of forming an electrically conductive wire member to include at least one first region wherein a portion of the wire is spring biased out of line with the adjoining portion, said first region also including a localized contact region, bending the conductive wire member intermediate the extremities to provide a generally U-shaped preform with the free extremities extending generally in the same direction forming an open portion at one end of the preform with a bight portion at the other end of the preform, the lateral spacing between opposing wire sections at a first end of the preform being greater than the lateral spacing between opposing wire sections at a second end of the preform, applying a first lateral compressive force to the preform to bring the localized contact region into electrical contact with an opposing section, surrounding the second end of the preform with a heat fusible material to retain the electrical contacting configuration, applying a second lateral compressive force to the preform to load energy in the first region by moving a portion of the wire inwardly against a spring bias, surrounding the heat fusible material and the adjacent portions of said second end of the preform with an additional amount of heat fusible material to retain the second end in spring loaded configuration, coating the heat fusible material with non-conductive rigid insulating material so that the opposing wire sections are electrically insulated except at the contact regions with the first end of the preform forming terminal wires and the second end forming a spring loaded thermal switch encased within heat fusible material and rigid insulating material.

12. The method of forming a thermal switch device in accordance with claim 11, wherein the first, wider spaced end of the preform includes the bight portion.

13. The method of forming a thermal switch device in accordance with claim 12, wherein the bight portion is weakened in predetermined locations and the preform is severed at said locations to provide a pair of terminal wires extending out of the rigid insulating material.

14. The method of forming a thermal switch device in accordance with claim 13, wherein the preform is severed after the first but before the second application of heat fusible material to the second end of the preform.

15. The method of forming a thermal switch device in accordance with claim 11, wherein the compressive forces are applied adjacent the first end of the preform remote from the first region including the spring portion and contact region.

16. The method of forming a thermal switch device in accordance with claim 11, wherein the heat fusible material is applied by dipping the second end of the preform in a heat fusible material in liquid form and allowing the liquid to cure as a solid.

* * * * *